United States Patent [19]

Steele

[11] 4,453,584

[45] Jun. 12, 1984

[54] SEALING SYSTEM FOR MOVABLE INSULATION

[76] Inventor: Richard S. Steele, 601 Alter St., Broomfield, Colo. 80020

[21] Appl. No.: 495,270

[22] Filed: May 17, 1983

Related U.S. Application Data

[63] Continuation of Ser. No. 266,209, May 22, 1981.

[51] Int. Cl.[3] ..... E06B 9/08

[52] U.S. Cl. ..... 160/121 R

[58] Field of Search ..... 160/23 R, 120, 121 R, 160/271-273, 290 R, 41, 264, 319-321

[56] References Cited

U.S. PATENT DOCUMENTS

| | | | |
|---|---|---|---|
| 730,440 | 6/1903 | Duchemin | 160/273 R |
| 1,882,982 | 10/1932 | Schmiedeskamp | 160/273 R |
| 2,009,917 | 7/1935 | Flanagan | 160/271 |
| 2,143,382 | 1/1939 | Martens | 160/264 |
| 2,325,992 | 8/1943 | Wirthman | 160/41 |
| 2,509,398 | 5/1950 | Peremi et al. | 160/23 R |
| 2,577,046 | 12/1951 | Svirsky | 160/321 |
| 4,078,492 | 3/1978 | Levy et al. | 160/264 |
| 4,187,896 | 2/1980 | Shore | 160/121 R |
| 4,194,550 | 3/1980 | Hopper | 160/121 R |
| 4,282,919 | 8/1981 | Teno | 160/290 R |

FOREIGN PATENT DOCUMENTS

| | | | |
|---|---|---|---|
| 1379077 | 10/1969 | France | 160/272 |

*Primary Examiner*—Peter M. Caun
*Attorney, Agent, or Firm*—Young & Martin

[57] ABSTRACT

Movable insulation is provided with sealing structural components to minimize or eliminate for practical purposes infiltration and convection currents in and around the movable insulation to enhance the thermal insulating quality of the assembly. Seal strips on the edges of the insulation pocket forming material layers are adapted to slidingly engage seal guides provided in the side frame channels of the assembly to seal the sides. Weight bars in the lower extremities of the insulation forming material sheets enhance the seal on the bottom as well as to keep the layers of material separated, and rotatable separating rollers on top also help to keep the layers separated and to form a seal on top. A smooth operating manual chain drive and anchor mechanism is provided, as well as a removable decorative fabric for the front of the assembly. Alternative embodiments enhance the seals and insulating quality of larger movable insulation assemblies, including top seal guide extensions for separating the layers, a bottom curved seal guide for accommodating the lower ends of edge seal strips to prevent binding and loss of bottom seal by accommodating differential length movement of front and rear layers, and edge seals for inner layers adopted for sealing edges as well as for maintaining layers separate in non-vertical applications.

25 Claims, 16 Drawing Figures

SEALING SYSTEM FOR MOVABLE INSULATION

This patent application is a continuation of U.S. patent application, Ser. No. 266,209, filed May 22, 1981.

BACKGROUND OF THE INVENTION

This invention relates to movable insulation devices for covering window and wall surfaces, and more particularly to improved seals for such movable insulation devices for minimizing or preventing air currents around, through, and within the devices from infiltration and convection.

Movable insulation adapted for use over walls and window areas of buildings to take advantage of the daily movements of the sun for efficient heating and cooling of the interiors of such buildings is beneficial and being used widely, particularly over large window areas such as those in commercial buildings and in passive solar homes. For example, in the winter it is desirable to allow the sun to shine through the windows into the interior of the building to take advantage of the radiant energy of the sun to heat the interior during the day and to place an insulation material over the window at night to minimize loss of heat from inside the building to the outside. Conversely, in the summer, it is desirable to have an insulation material in place over the window surfaces during the day to minimize heat from the sun heating up the interior of the building, and to remove the insulation material from the window area at night to allow the heat inside the building to dissipate through the windows to the cooler night air.

There have been a number of movable insulation curtains developed over the past several years that are adaptable to moving into place over windows and retraction away from the window surfaces to maximize the use of the day and night cycles of the sun to heat and cool homes and other buildings. The most popular of these devices have usually included some variation of multiple layer retractable curtains or shades which form air spaces or pockets between the layers to utilize the insulation quality of air to insulate against thermal transfer through the window surfaces. Examples of such devices include those disclosed in U.S. Pat. No. 4,039,019, issued to T. Hopper, and U.S. Pat. No. 4,187,896, issued to R. Shore. The disclosures in both of those patents recognize the importance of sealing the sides and ends of the insulation against infiltration and convection currents in order to maximize the use of the air pockets for insulation. However, while recognizing the problem, these and other prior art devices have so far continued to suffer from significant insulation value losses due to infiltration and convection currents because of inadequate seals around the sides and edges of the air pockets formed by the multiple layer movable insulation forming materials. While some of these prior art structures might be effective when hand placed in proper position over the windows, the desirability for automatic raising and lowering with a minimum of manual attention to positioning has caused effective seals for the air pockets to be an illusive goal for inventors and manufacturers for such movable insulation devices. The illusiveness of this goal is compounded when it is desired to also provide more attractive decorative fabrics for positioning over the front or interior side of the movable insulation layers to present more pleasing appearance for the interior of the buildings than is normally obtained from the light reflective fabrics and films commonly used to form the air pocket envelopes in such devices.

SUMMARY OF THE INVENTION

Accordingly, it is an object of the present invention to provide effective seals for the sides and edges of multiple layer air pocket forming movable insulation devices.

It is also an object of the present invention to provide effective seals for the edges of multiple layer movable insulation devices which can accommodate sliding movement of the layer edges as the insulation forming material is moved into place and withdrawn.

Another object of the present invention is to provide seals for the layers of multiple layer movable insulation devices which positively engage and retain the layers of insulation forming material in the guides as the insulation is moved into and out of place.

An additional object of the present invention is to provide seals which can accommodate differential movement between various layers of the insulation forming material due to difference in radius of curvature of the material over the retraction roller of such devices which move the insulation forming material by means of wrapping around a roller.

Still a further object of the present invention is to provide decorative fabric coverings for such multiple layer movable insulation devices which is attractive, fully movable without jamming or wrinkling, and yet which does not interfere with the seals for the sides and edges of the layers of insulation forming material.

It is another object of the present invention to provide such decorative fabrics which are easily removable for changing or cleaning.

Still another object of the present invention is to provide a structure wherein the decorative fabric also provides a positive mechanical seal against infiltration.

Another object of the invention is to provide side and edge seals for the multiple layers of insulation forming fabric which not only seal but which mechanically maintain the separation of the outer and inner layers of the insulation forming material in both vertical and non-vertical installations.

Another object of the invention is to provide a manually operable roller retraction assembly for multiple layer movable insulation forming materials which are easy to operate and which will continue to operate effectively without undue maintainence or wear over long periods of time.

The present invention is directed to a system and structure for sealing the lateral sides, top, and bottom of multiple layer movable insulation devices to minimize infiltration and convection currents that decrease insulation effeciency of such devices. The side seals include returned edge strips along the lateral edges of the layers which are adapted to engage oppositely directed rigid seal guides formed in enclosed side frame channels in which the edges of the layers are positioned when in place over windows. The positive mechanical engagement of the seal strips with the seal guides prevent the layered sheets from being pulled out of the frame channels from expansion of the layers or from movement of the layers longitudinally within the channels as the insulation forming materials are being moved into or out of position. The seals also include sealing edges along the tops and bottoms of the multiple layered fabrics, the bottom which seals on the floor and the top which seals under or within an enclosed housing that covers the retraction roller assembly. The seals are also adapted to maintain physical separation of the layers to prevent cold shorts, even when the movable insulation forming layers are positioned in non-vertical applications, such as in front of slanted or horizontal window surfaces. The invention also includes advantageous use of a decorative fabric covering which is easily detatchable and removable from the front of the insulation forming material and which runs within the side frame channels along with the insulation forming sheets or layers but does not interfere with the seals, and in one embodiment in fact provides a mechanical seal. Advantageous positioning of the roller assembly housing structure in relation to the side frame channels provides an easily accessible smoothly operating front depending pull chain drive for manually operating the retraction roller assembly.

BRIEF DESCRIPTION OF THE DRAWINGS

Other objects, advantages and capabilities of the present invention will become more apparent as the description proceeds taken in conjunction with the accompanying drawings, in which.

DETAILED DESCRIPTION OF THE PREFERRED EMBODIMENTS

Figure 1:
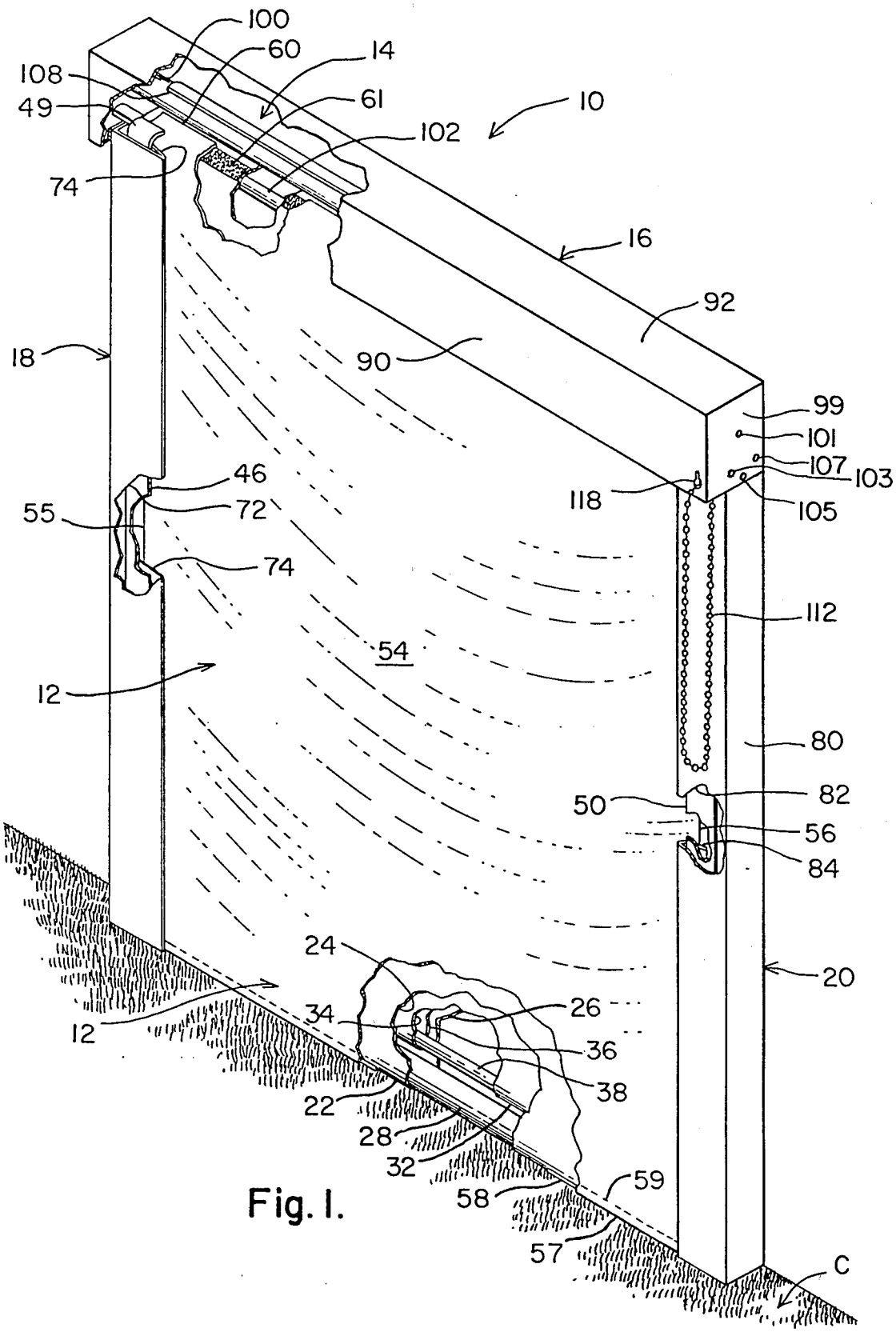
FIG. 1 is a perspective view of the movable insulation assembly 10 of the present invention shown with the insulation in place over a window, and various cutaway portions illustrate the components and structure.
Figure 2:
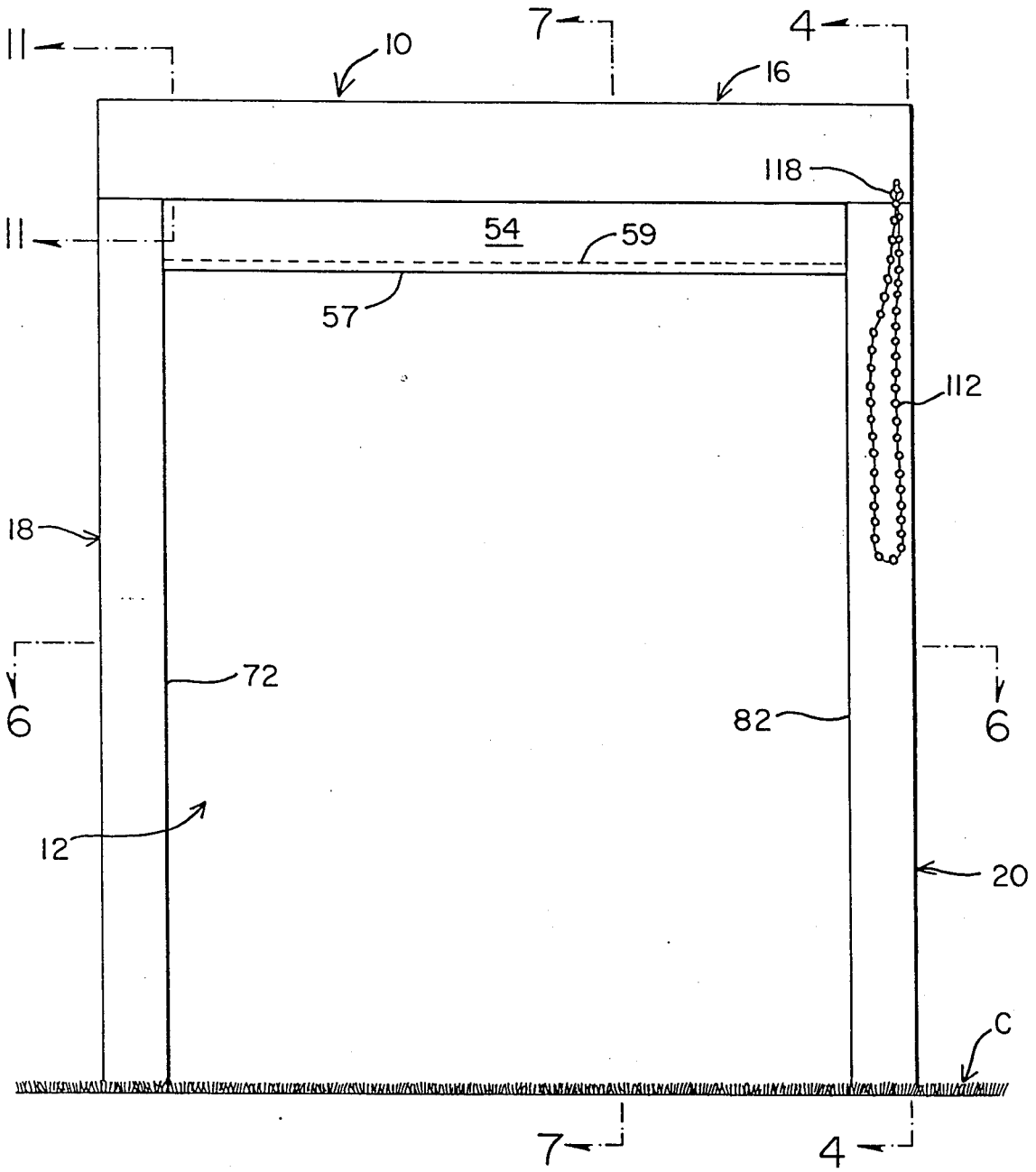
FIG. 2 is a front elevation view of the movable insulation assembly shown with the insulation moved to the raised position to expose the window over which it is positioned.
Figure 3:
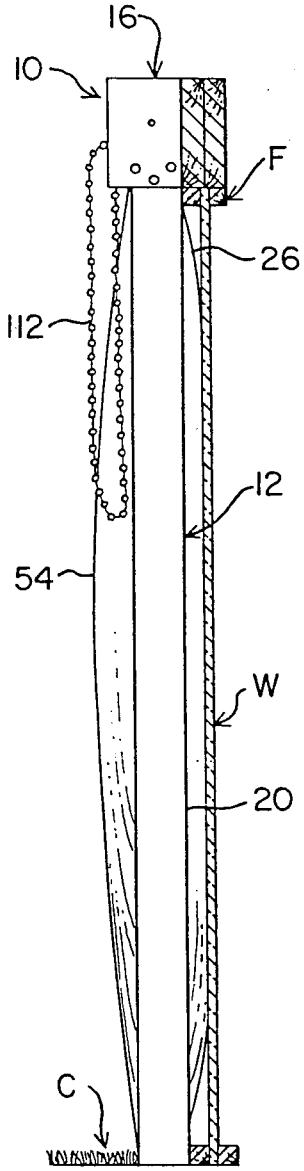
FIG. 3 is a left side elevation view of the movable insulation assembly in position over the front of a window.

The movable insulation assembly 10 of the present invention is shown in FIG. 1. It is designed for positioning over windows in a building for insulation when it is desired to keep heat out or in. It can also be raised, as shown in FIG. 2, to allow heat to be transmitted through the window if desired. The movable insulation assembly 10, as best seen in FIGS. 1 through 4, is comprised essentially of several layers of material 12 forming insulation air pockets 40, 42, 44, a roller assembly 14 for raising and lowering the insulation pocket-forming material 12, left and right frame channels 18, 20 respectively, for sealing the sides of the insulation pockets, and a roller assembly housing 16 for covering the roller assembly and sealing the top portion of the movable insulation assembly 10. As best shown in FIG. 3, when the insulation pocket-forming materials 12 are in position over a window W, the air in the insulation pockets 40, 42, 44 expand the material 12 to provide an effective insulation barrier to thermal conductivity through the window. The window W is shown in FIG. 3 mounted in frame F in a conventional manner, and the movable insulation assembly 10 is shown mounted directly in front of the window W.

For a more detailed description of the insulation pocket-forming materials 12, reference is made to FIGS. 1, 4, 6, and 7. The insulation pocket-forming material 12 is basically comprised of two sheets of fabric or film, including an outer sheet 22, and an inner sheet 32. Both the outer and inner sheets 22, 32, respectively, are fastened along their upper edges to a main roller 100 by suitable fasteners, such as the adhesive strip 108 shown in the drawings. Of course, other methods, such as screws, bars and slots, and the like can also be used to fasten the sheets to the roller. From the main roller 100, the sheets 22, 32 depend downwardly in double layers with the front and rear layers 34, 36 of inner sheet 32 positioned between the front and rear layers 24, 26 of the outer sheet 22. An outer weight bar 28 is positioned to hang in the lower extremity of inner sheet 32. These weight bars 28, 38 maintain the respective outer and inner sheets 22, 32 fully extended in such a manner that air spaces on pockets 40, 42, 44 are formed between the layers of the sheets to function as thermal insulation. The front space or insulation pocket 40 is formed between the front layers 24 34 of the respective outer and inner sheets 22, 32; an intermediate space or insulation pocket 42 is formed between the front and rear layers 32, 36 of inner sheet 32; and a rear space or insulation pocket 44 is formed between the rear layers 26, 36 of the respective front and rear sheets 22, 32.

Figure 7:
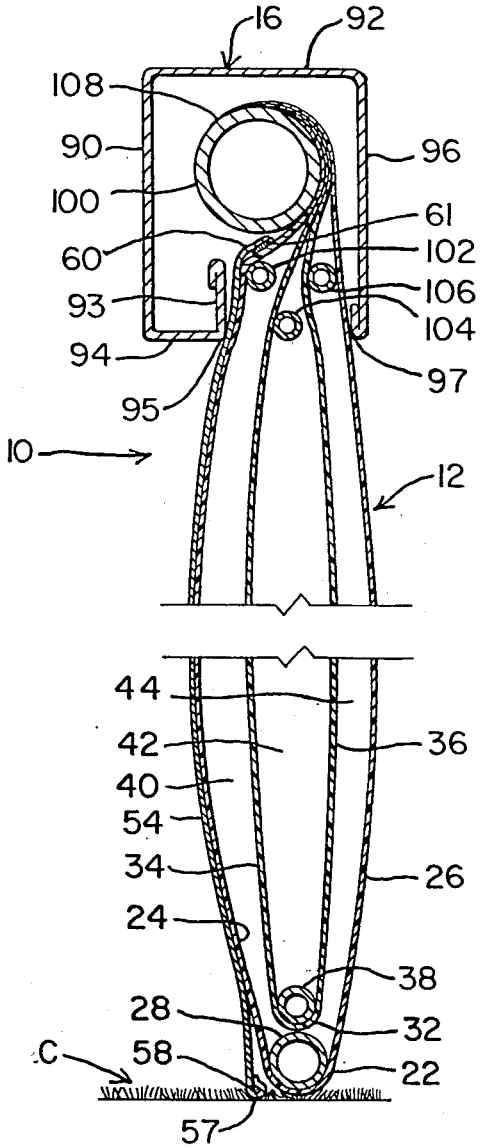
FIG. 7 is a sectional view of the movable insulation assembly taken along lines 7—7 in FIG. 2.

As the air in the insulation pockets 40, 42, 44 is heated by the sun, the air expands causing the sheets 22, 32 to inflate as shown in FIGS. 3 and 7 to result in a significant value of thermal insulation. Some movable insulation assemblies include openings (not shown) near the bottom extremities of the inner and outer sheets to allow additional air to enter by convection to further inflate the insulation pockets as the warm air rises to the tops of the pockets. Such openings are particularly advantageous on larger movable insulation assemblies designed to cover large window areas.

The sheets 22, 32 can be raised by rotating the main roller 100 in one direction, and they can be lowered by rotating the main roller 100 in the opposite direction. Manual drives for rotating the main roller can be used, as shown in FIGS. 1 through 4, or powered motors can be used. Electric powered motors are particularly advantageous in larger installations where manual raising and lowering would be tedious and where temperature sensing devices located inside and outside the window can be used automatically to activate the motors as temperature differentials inside and outside the building warrant. The basic structural components of the movable insulation assembly 10 described above are known in the prior art and form no part of this invention in and of themselves.

Figure 4:
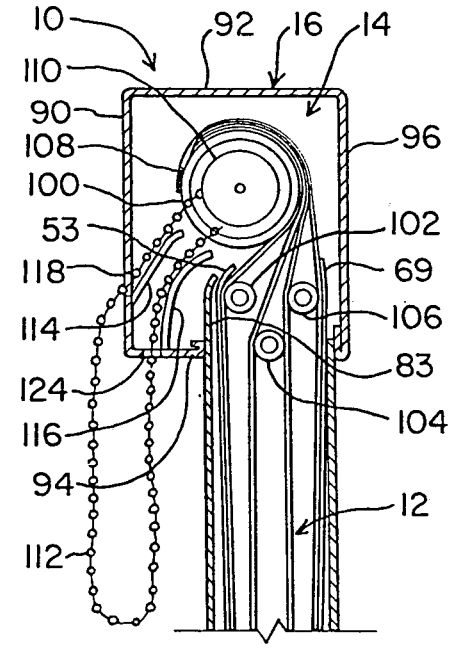
FIG. 4 is a sectional view of the movable insulation assembly taken along lines 4—4 of FIG. 2.
Figure 4:
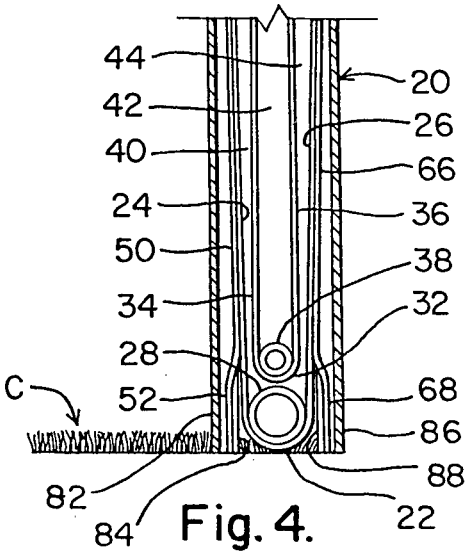
Figure 6:
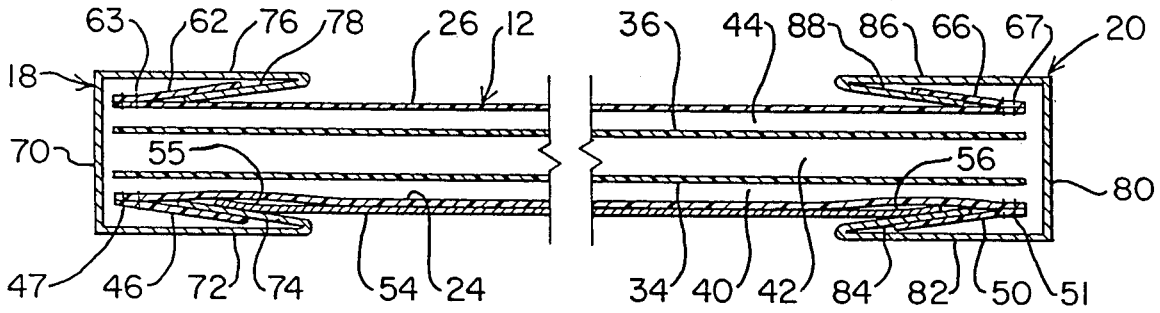
FIG. 6 is a cross section view of the insulation material and its seal components taken along lines 6—6 of FIG. 2.
Figure 9:
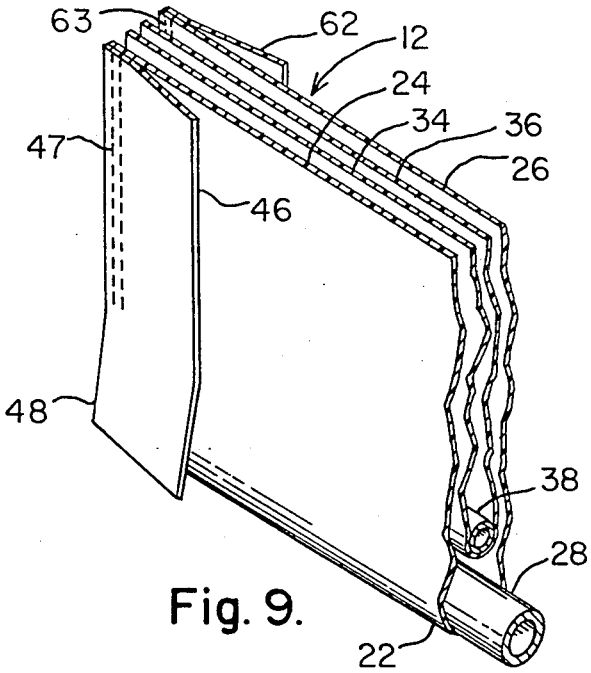
FIG. 9 is a perspective view of the lower left portion of the insulation material showing a typical detail of the seal.

A significant feature of this invention is the improved seals for sealing the top, bottom and sides of the movable insulation assembly 10 from infiltration and convection air currents to enhance the thermal insulation capability. As best seen in FIGS. 4, 6, and 9, elongated flexible sealing strips 46, 62, 50, 66 are attached to the lateral edges of the outer sheet 22. For example, referring specifically to FIG. 9, a flat, elongated flexible sealing strip 46 is attached to the left edge of front layer 24 in such a manner that it returns along the outside surface of the front layer 24, and a flexibility of the material leaves a narrow gap or space between the sealing strip 46 and the front layer 24. A similar sealing strip 62 is attached by stitching 63 to the left edge of the rear layer 26 in a manner such that the strip 62 returns a short distance along the outside surface of rear layer 26 leaving a narrow gap or opening therebetween. Likewise, a sealing strip 50 is attached by stitching 51 to the right edge of outer layer 24, and the sealing strip 66 is attached by stitching 67 to the right edge of the rear layer 36 in a similar manner as the attachment of the sealing strips 46, 62 described above for the left edges. Although stitching elongated flexible seal strips to the lateral edges of the material layers as shown in the drawings and described above as one feasible manner in which the seal strips can be formed, it is also contemplated that they could be formed with equal effectiveness by other suitable attachment methods, such as adhesives, heat sealing, and the like. It is also contemplated that the seal strips can be formed merely by folding the sheet material edges back onto themselves and permenently creasing the folds. This latter method is particularly advantageous where the insulation forming sheets are plastic films, such as "Mylar," in which the folds can be creased permanently by heat pressing.

Figure 8:
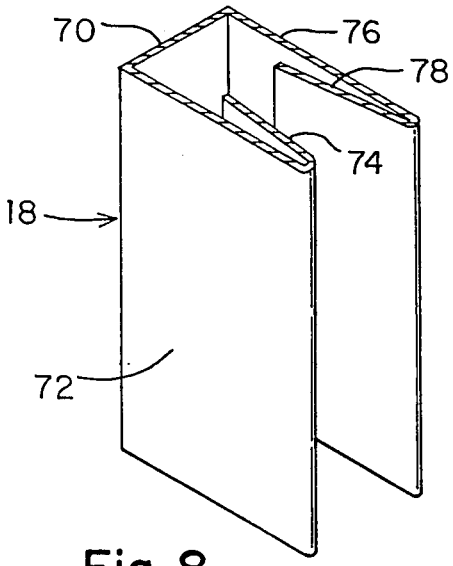
FIG. 8 is a perspective view of a section of the left side frame channel showing the structure of the seal guides therein.

Referring now primarily to FIG. 8 in combination with FIG. 9, and secondarily to FIGS. 1, 4, and 6, the side channel frame members are provided with seal guides to run in the gaps between the sealling strips and the outer sheet. For illustration, a section of the left side frame channel member 18 is shown, and includes a side panel 70, front panel 72 extending outwardly from the front edge of the side panel 70, and a rear panel 76 extending outwardly from the rear edge of the side panel 70. The distal end of the front panel 72 is folded inwardly toward itself to form seal guide 74, which extends toward side panel 70. A narrow gap is left between front panel 72 and seal guide 74. Likewise, the distal end of rear panel 76 is folded inwardly toward itself to form rear seal guide 78.

The seal guides 74, 78 in frame channel 18 are formed of a shaped and size adapted to receive the seal strips 46, 62 on the left edges of the outer sheet 22 in such a manner that a sheet 22 can slide freely upwardly and downwardly in channel frme 18, but it cannot be pulled out of channel frame 18. FIGS. 1, 4, and especially FIG. 6 illustrate the outer and inner sheets 22, 32 respectively, properly assembled in the left and right frame channels 18, 20, respectively. The seal guides 74, 78 in the left frame channel 18 are positioned in the gap between the seal strips 46, 62 on the left edges of outer sheet 22. When sealed in this manner, the frame channels 18 prevent any air flow from the air pockets 40, 42, 44 out the sides of the insulation forming material 12.

As the insulation pockets 40, 42, 44 between the material layers expand as described above from heat generated by the sun, the seals between the outer sheet 22 and the left and right frame channels 18, 20 are tightened to significantly increase their effectiveness in preventing infiltration and improving the thermal insulating quality of the assembly, yet the transverse forces caused by the expansion cannot pull the sealed surfaces out of the frame channels 18, 20 even when the sheets are pulled upwardly in the channels by the roller 100 to raise the insulation assembly 12.

As best seen in FIGS. 4 and 9, a segment of the seal strips near the bottom of the insulation forming material 12 are not attached to the outer sheet 22. This feature is necessary to allow the portions of the outer sheet 22 adjacent the weight bar 28 at the bottom of the assembly 12 to hang freely without causing the seal strips and sheet edges to bind or hang up in the seal assembly. Also, as will be described in more detail below, particularly in larger insulation assemblies for covering large windows, the rear layer 26 is positioned outermost on the main roller 100, while the front layer 24 is positioned innermost on the main roller 100. Therefore, since the radius of curvature of the outer layer 26 around the roller 100 is greater than the radius of curvature of the inner layer 24, the outer layer 26 is pulled upwardly and let downwardly a greater distance than the inner layer 24. The differential in travel distance between layers 24, 26 of sheet 22 causes an unevenness at the lower extremity of sheet 22 about weight bar 28 for which accommodation must be made in the seal assembly. The loose ends or flaps 48, 52, 64, 68 on the bottom ends of the seal strips 46, 50, 62, 66, respectively, accommodate this differential immovement between the front and rear layers 24, 26 outer sheet 22 without binding or jamming the seal strips in the seal guides of the side frame channels.

As mentioned above, the main roller 100 draws the insulating pocket forming material 12 upwardly by rolling the material around its peripheral surface. As the main roller 100 is rotated in the opposite direction, the insulating pocket forming material 12 is unrolled from its peripheral surface and descends downwardly in the frame channels 18, 20. As the material 12 descends downwardly, it is important that the several layers 24, 26, 34, 36 all remain separated from each other in order to form the insulation pockets 40, 42, 44 between them. If any of the layers are touching each other, the material forms a cold short in which the heat is conducted through the materials, thereby losing the benefit of the air pockets for insulation, which decreases the thermal insulation effeciency of the material 12 significantly. As mentioned above, the weight bars 28, 38 in the respective outer and inner sheets 22, 32 function to maintain the separation of the layers toward the lower extremities of the material 12. In addition, the separation rollers 102, 104, 106 are provided as part of the roller assembly 14 and immediately under the main roller 100 to initially separate the layers as they are unrolled off the main roller 100 and to maintain the layer separation at the upper end of the material 12, thereby also functioning to prevent cold shorts by one layer touching another. The separation rollers are spaced apart with the front roller 102 positioned between layers 24, 34 the middle roller 104 positioned between layers 34, 36, and the rear roller of 106 positioned between the layers 36, 26. It is preferred that the separation rollers 102, 104, 106 are fully rotatable about their longitudinal axes to minimize friction and dragging of the layers over the peripheral surfaces of the rollers as the material is drawn upwardly or descending downwardly. The upper extension 83 of the front panel 82 of right side frame channel 20 shown in FIG. 4 helps to guide the seal strip 50 into the gap between front panel 82 and front sea guide 84 during decent as the seal strip 50 comes off roller 102.

A roller assembly housing 16 comprised of a front panel 90, top panel 92, bottom panel 94, left panel 98, and right side panel 99, is positioned to cover the roller assembly 16 and to seal the upper portion of the movable insulation assembly 10 from infiltration and leakage of air. In this structure, the interior of housing 16 is in communication with the air pockets 40, 42, 44 and with the interiors of frame channels 18, 20, but this entire interior air space is sealed from air outside the movable insulation assembly 10.

As mentioned above, the main roller 100 can be either power driven with a motor or manually rotated. In the embodiments shown in FIGS. 1 through 4, a manual chain drive is provided, which includes a sprocket 110 attached to the main roller 100 and a chain 112 extending forwardly and downwardly from the sprocket 110. Another significant feature of this invention is the position of the pull chain 112 in the front of the assembly instead of the conventional position at the side. The front panel 90 of the housing 16 is positioned a spaced distance forwardly of the main roller 100 and chain sprocket 110, and it is also a spaced distance forward of the insulation forming material 12 and side frame channel 20. A small opening 118 is provided in the front panel 90, and another small opening 124 is provided in forward portion of the bottom panel 94 to accommodate passage of the chain 112 therethrough. Chain guides 114, 116 are provided on the interior of the housing 16 to guide the chain from the sprocket to the respective openings 118, 124 for smooth, bind-frree operation.

Figure 5:
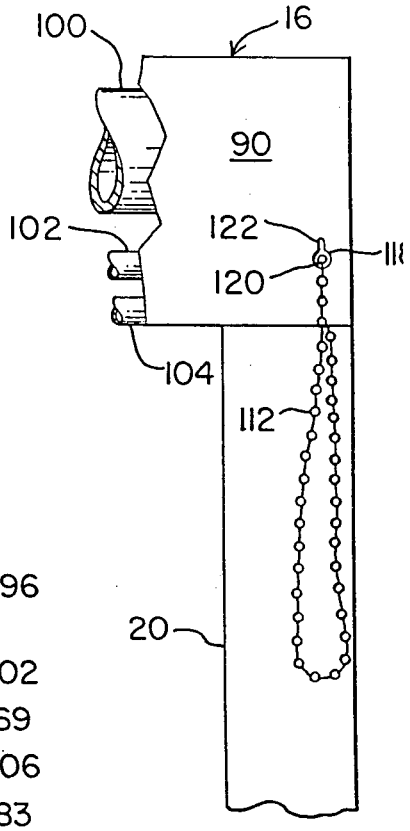
FIG. 5 is an enlarged elevation view of the upper right portion of the movable insulation assembly to illustrate the chain lock device.

As best seen in FIG. 5, the opening 118 in the front panel 90 includes an anchor feature for anchoring the chain to hold the insulation forming material 12 in a raised position. The lower portion 120 of the opening 118 is wide enough for the ball links of the chain 112 to pass through easily. The top portion 122 of opening 118, however, is a narrow slot that is only wide enough to receive the connecting link portions of the chain 112, but not wide enough to allow the passage of the ball link portions of the chain 112. Therefore, when it is desired to hold the insulation forming material 12 in a raised position, the chain is lifted to position a connecting link in the narrow slot portion 122 and to bind a ball link of the chain against the wall of the front panel 90 adjacent the narrow slot portion 122 of opening 118.

As best seen in FIGS. 1, 6, and 7, the decorative fabric 54 is an optional layer of pleasant looking material positioned over the front layer 24 of outer sheet 22 for use when the appearance of the common smooth or shiny fabrics or films used for the insulation forming sheet 22 in the interior of the building is not desired. The decorative fabric 54 is removably attached to and hung from the upper portion of front layer 24 by "Velcro" fastener strips 61 affixed to the decorative fabric 54 adjacent its top edge 60 and to the front layer 24 near its top just under the main roller 100. The decorative fabric extends downwardly over the front layer 24. The left edge 55 of the decorative fabric 54 is positioned to slide between the seal guide 74 and the front layer 24, and the right edge 56 is positioned to slide between the seal guide 84 and the front layer 54, as best shown in FIGS. 1 and 6. A weight bar 58 is also suspended at the bottom edge 57 of decorative fabric 54 by folding the end 57 back onto itself and fastening it there, such as by sewing 59 to form a pocket around the weight bar 58. The weight bar 58, which also moves up and down adjacent the seal guides 74, 84 helps to keep the decorative fabric 54 hanging straight and to assist in forming the infiltration seal by laying on the carpet C when insulation forming material 12 is in the fully extended position. The decorative fabric 54 is optional, and it can be removed easily for cleaning or changing to a different fabric simply by detaching the Velcro fastener strip 61.

As best seen in FIGS. 6 and 7, when the insulation forming material 12 is fully descended to where the lower extremities of outer sheet 22 and lower edge 57 of decorative fabric 54 rest on the carpet C on the floor of the building, and when the insulation pockets 40, 42, 44 are expanded by heated air, the seal is complete. The edge seals of the layers shown in FIG. 6 keep infiltration from circulating around the lateral edges of the layers in the frame channels and the air in the interior of the assembly 10 cannot escape. The outer sheet 22 positioned firmly on the carpet C by weight bar 28 keeps air from moving under the insulation forming material 12. Finally, the inflated front layer 24 expanded against the inerior return portion 93 of the housing 16 forms a front seal at 95, and a rear seal 97 is formed between the rear layer 26 and the lower portion of the back panel 96 to prevent air circulation into or out of the housing. Therefore, the entire movable insulation assembly 10 is for practical purposes sealed on both lateral sides and on the top and bottom from infiltration and convection air currents, thereby significantly enhancing the thermal insulating quality of the assembly 10.

Figure 10:
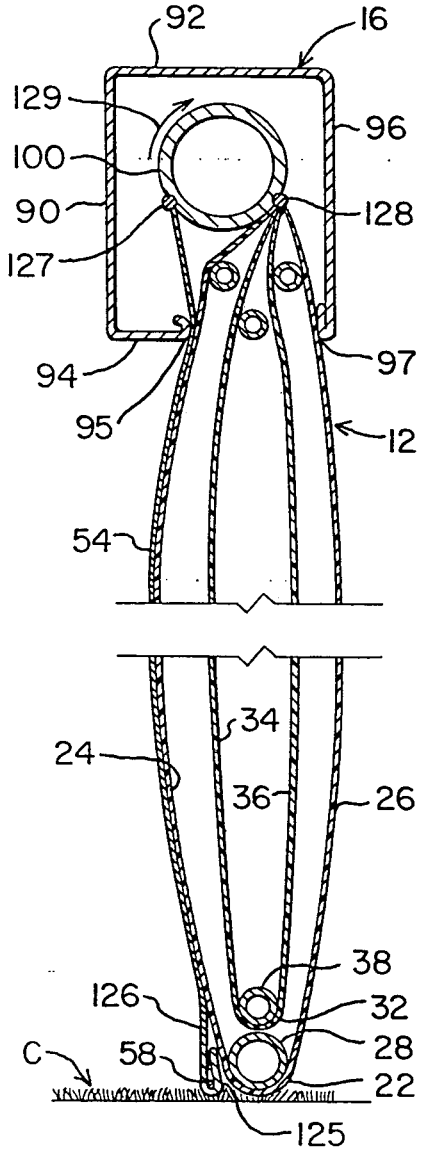
FIG. 10 is a cross section in elevation similar to FIG. 7, but showing a variation of the decorative fabric attachment to create a positive mechanical seal with the roller assembly housing.

There are several variations of the structure of the present invention that can be used singly or together in any combination with the embodiment already described. One example of such a variation is shown in FIG. 10, where an alternative attachment of the decorative fabric 54 advantageously creates a positive mechanical seal 95 as well as tightens the fabric 54 to eliminate ripples or bulges for insuring a neat, pleasing appearance. The decorative fabric 54 in this variation is attached at its top edge to main roller 100 a spaced distance (preferably about 120 degrees) from the attachment 128 of the insulation forming material 12 to the main roller 100. The lengths of the sheets 22, 32 of insulation forming material 12 are predetermined to reach the bottom or carpet C when the point of attachment 128 is on the lower rear side of main roller 100. In this position, the attachment 127 of decorative fabric 54 is on the lower front side of main roller 100. Therefore, as the main roller 100 rotates in the direction indicated by arrow 129 to unroll the material, just as the sheet 22 approaches the carpet, the roller 100 will begin to pull the top of the decorative fabric forward and up, as shown in FIG. 10. This position causes the decorative fabric to positively form a mechanical seal at 95 with bottom panel 94 at the opening into the interior of the housing 16. A "Velcro" fastener strip 126 is provided at the bottom edge 125 of edcorative fabric 54 to accommodate adjustment of the length of decorative fabric 54 while still forming a pocket to contain weight bar 58. Therefore, the bottom of fabric 54 can be adjusted so that the fabric 54 is fully extended and touching the carpet C when main roller 100 stops rotating. Consequently, the forward and upward pull of the roller 100 on the decorative fabric 54 not only creates the mechanical seal 95, but it also pulls the decorative fabric taut to eliminate wrinkles and folds to present a neat, pleasing appearance in the interior of the building.

Other variations are particularly suited for application in large movable insulation assemblies for covering large windows; therefore, they will be described in the form of an alternative embodiment as shown in FIGS. 11 through 14. In very wide window applications where the roller assembly must be very long to span the window, it is impractical to use the separation rollers 102, 104, 106 of the preferred embodiment described above, since the weight of the small diameter rollers in such a wide span tends to sag the rollers causing a significant deflection at midsection to the extent that they are ineffective for purposes of separating the layers. Therefore, the other embodiments have been designed with alternative structures to seal the movable insulation assembly from convection and infiltration air currents and to maintain the physical separation of the several layers of insulation forming material.

Figure 11:
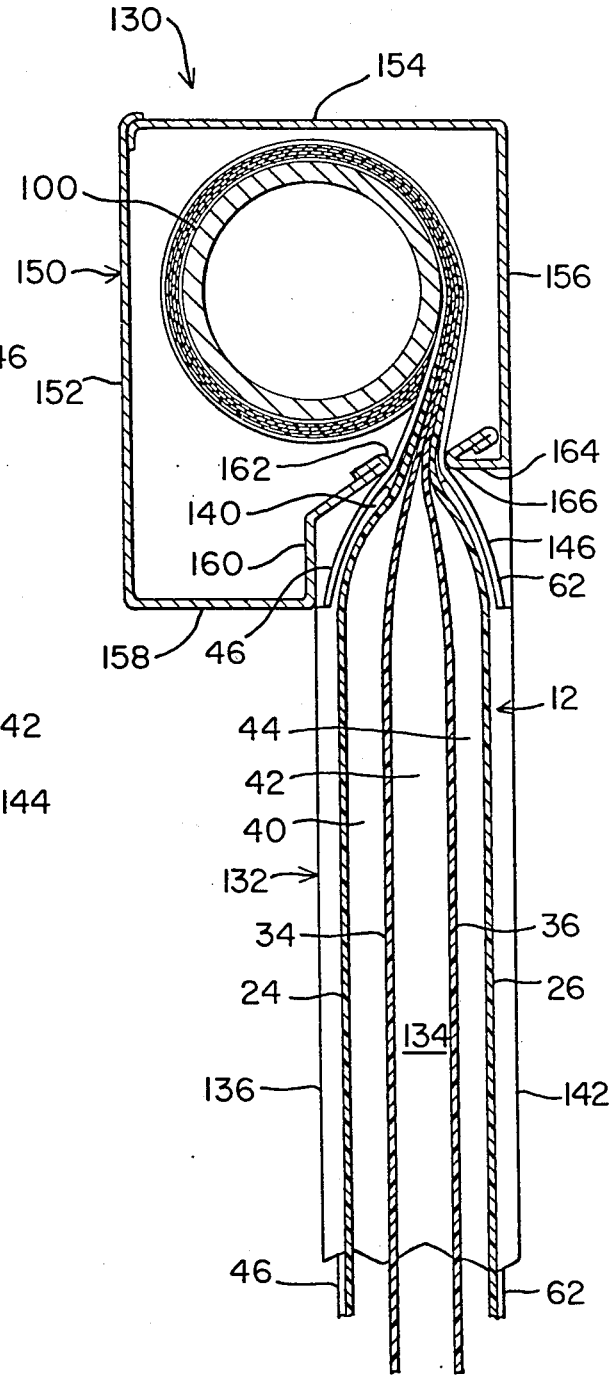
FIG. 11 is a sectional view of an alternative embodiment of the roller assembly, seals, and side frame channels taken along lines 11—11 of FIG. 2.

The embodiment shown in FIG. 11 was designed to exclude the interior of the housing 150 from the interior air pockets in the insulation forming material 12. The interior of the insulation forming material 12 is sealed off on top at the location where it enters the housing 150. This feature is accomplished by extending the interior vertical partition 160 rearwardly toward the rear side return 164 at the base of rear panel 156 to provide only a narrow opening therebetween just sufficient to allow the passage of the layers of insulation forming material 12 therethrough as it is rolled onto and unrolled from the main roller 100. In this structure, the interior of the insulation forming material 12 between the layers thereof is confined to the insulation air pockets 40, 42, 44, and the interior of the side frame channels. The air in these insulation pockets cannot circulate into the interior of the housing 150; therefore, the interior of the housing 150 does not have to be sealed from the exterior. The respective distal ends 162, 164 of the interior partition 160 and rear return 164 also form deflation bars which squeeze the layers together and force out the air in insulation pockets 40, 42, 44 as the insulation forming material 12 is being drawn into the housing 150 to be wrapped around the main roller 100.

Figure 14:
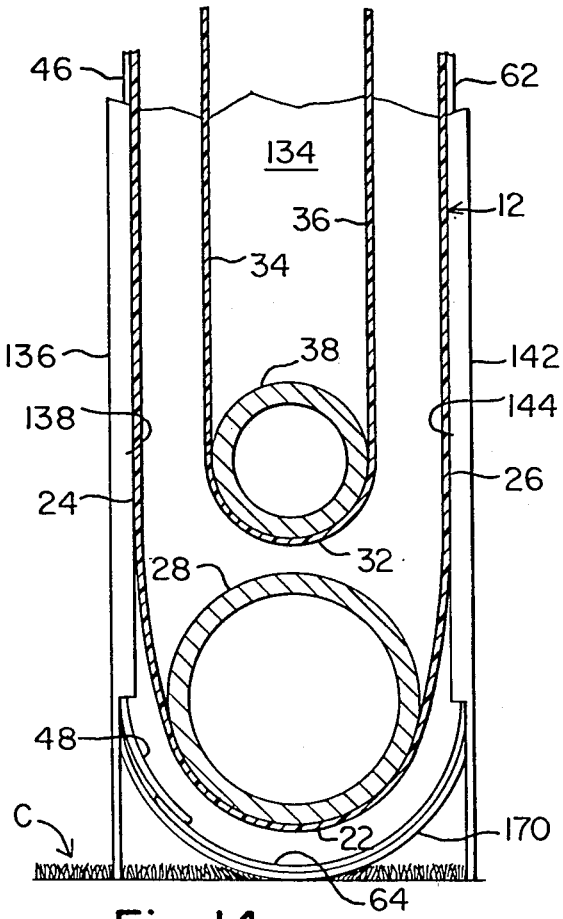
FIG. 14 is a sectional view in elevation of the bottom portion of the left side channel frame assembly shown in FIG. 13 with the insulation material in lowered position and showing the position of the seal strips therein in the curved seal guide.
Figure 12:
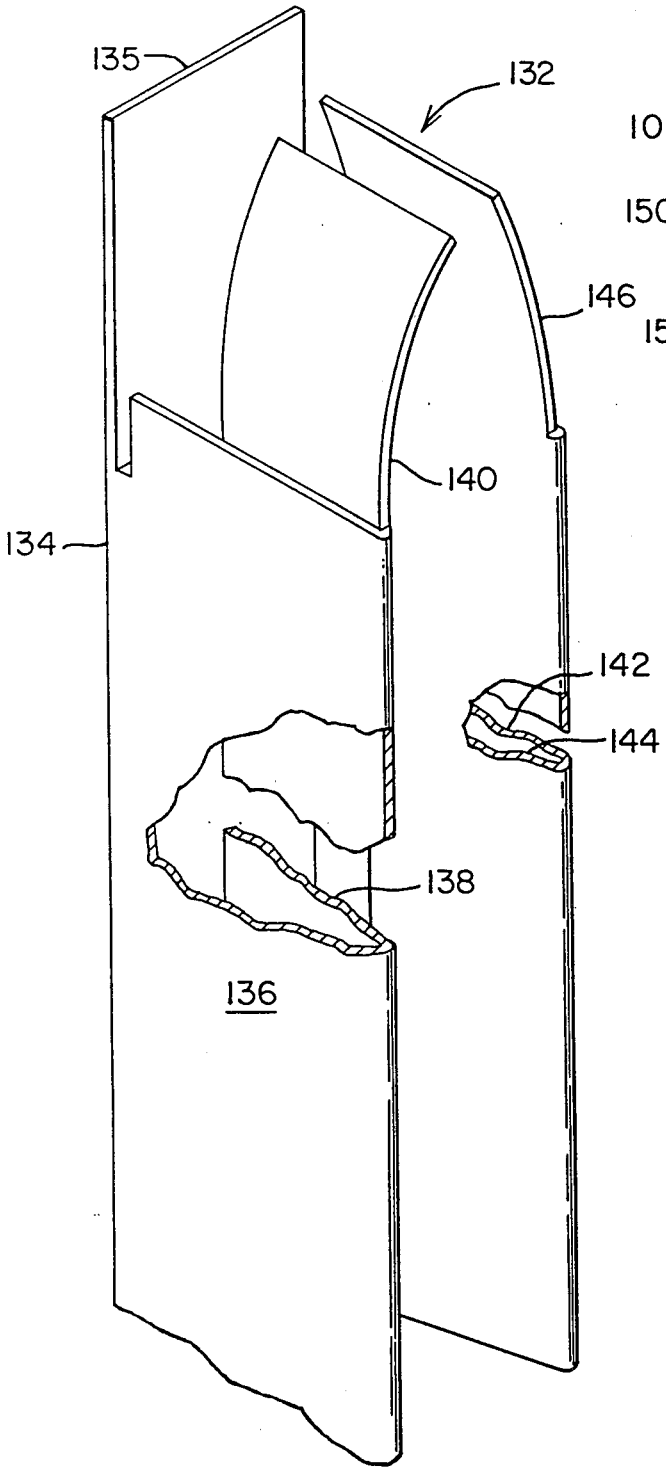
FIG. 12 is a perspective view of the upper portion of the left side channel frame assembly of the alternative embodiment of FIG. 11.

This embodiment shown in FIG. 11 can still utilize the weight bars 28, 38 at the bottoms of sheets 22, 32, as shown in FIG. 14, for spreading the layers 24, 34, 26, 36 at the bottom; however, without the separation rollers on top, another structure at the top of the side frame channels is needed to physically separate the layers as they are unrolled from the main roller 100. The side frame channels shown in FIGS. 11 and 12 serve that function. Although the portion of the side frame channels shown in FIGS. 11 and 12 is the upper section of a left frame channel, it is typical of the structure of the right frame channel in this embodiment as well. The left frame channel of this embodiment includes a side panel 134 with a front panel 136 extending outwardly from the front edge of side panel 134 and a rear panel 142 extending outwardly from the rear edge of side panel 134. Similar to the side frame channels of the preferred embodiment described above, the side frame channels of this embodiment also include inwardly bent front seal guide 138 and rear seal guide 144 for engaging and guiding the edge seal strips 46, 62 of the outer sheet 22, as described above for the preferred embodiment. However, in this embodiment, the front seal guide 138 is extended upwardly beyond the top of front panel 136 and curves slightly inwardly as shown at 140. The rear seal guide 144 also has a similar top extension 146 extending upwardly from and curved slightly inwardly from rear seal guide 144. These upper extensions 140, 146 of the seal guides 138, 134 extend to the vicinity of the opening between edges 162, 164 of the housing 150. Therefore, as the layers are unrolled off the main roller 100 and descend downwardly through the opening between edges 162, 166, the seal strips 46, 62 slide over the extensions 140, 146, respectively, thereby tending to physically pull the outer layers 24, 26 away from the inner layers 34, 36 as shown in FIG. 11. The upper extension 135 of side panel 134 is provided to seal the upper end of the frame channel against the under side of the housing 150.

Figure 13:
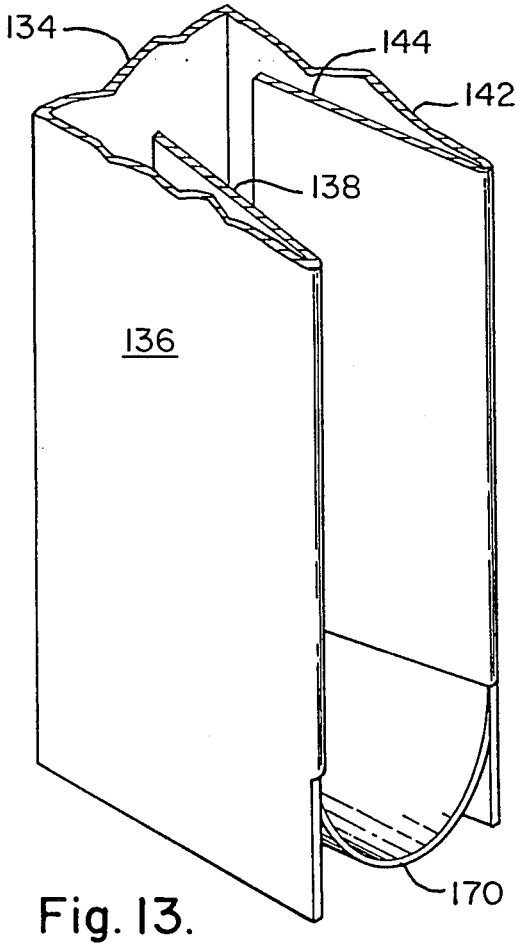
FIG. 13 is a perspective view of the bottom portion of the left side frame channel seal assembly with a bottom curved seal guide.

Another significant feature of this invention described as a part of the alternative embodiment is shown in FIGS. 13 and 14. It includes a curved seal guide 170 on the bottom of the frame channel. This feature is provided to alleviate a problem with the seals that occurs in larger movable insulation assemblies. The problem arises due to the larger radius of curvature of the rear layer 26 wrapped over the main roller 100 as compared with the radius of curvature of front layer 24, as mentioned briefly above. In applications where the insulation forming material 12 is very long to cover very long or high windows, the rear layer 26 unrolls a significantly longer rear portion of material than the front layer 24 due to the differential in radius of curvatures as described above. Therefore, the lower ends 48, 64 of the seal strips 46, 62, respectively, reach the bottom of the frame channel at different times. Because a longer length of rear layer 26 is unrolled from the main roller 100, the lower end portion 64 of the seal strip 62 reaches the bottom of the frame channel before the weight bar 28 and outer sheet 22 reaches the floor. If the end 64 of the seal strip 62 is not accommodated in some manner as it reaches the floor, it would cause the outer sheet 22 to bind up and not reach the floor or the carpet C, thus preventing a seal between the carpet C and the lower extremity of outer sheet 22, as is required for preventing infiltration and creating a good thermal insulation. Further, it is almost impossible or at least very impractical to try to adjust the length of the bottom end 64 of seal strip 62 to reach the floor at the same time as end 48 of seal strip 46, since making it too short could cause the seal strip 62 to come out of the seal guide 144 at the top end. Also, the natural variations in the length of the layers due to stretching and distortion of the fabric or film of which the material is fabricated would also make it extremely difficult if not impossible to adjust the length of the lower end 64 to always reach the floor at the same time as end 48 of seal strip 46. Therefore, in order to keep the lower end 64 of seal strip 62 from binding at the bottom of the frame channel and holding up the lower extremity of outer sheet 22 to prevent a seal, the curved bottom portion 170 of the seal guide is provided as shown in FIGS. 13 and 14. The curved portion 170 extends from the rear panel 142 in a curvature downwardly and then upwardly to the front panel 136 to form a continuous track from the rear gap between seal guide 144 and rear panel 142 to the front gap between seal guide 138 and front panel 136. Therefore, as shown in FIG. 14, when the lower end 64 of seal strip 62 reaches the bottom of seal guide 144, the curved guide portion 170 causes the end 64 to merely continue by curving it downwardly and inwardly, around, and back upwardly without binding or hanging up. The weight bar 28 is shown in FIG. 14 just before it is lowered all the way to the carpet C for clarity in illustrating the position of the lower end 64 of seal strip 62. However, with the lower end 64 of seal strip 62 guided to return upwardly in a smooth orderly fashion as shown in FIG. 14, the weight bar 28 and lower extremity of outer sheet 22 can be lowered the entire distance to seal with the carpet C without any interference from the seal strip 62. Also, as the lower end 48 of seal strip 46 extends downwardly from front seal guide 138, it also can follow the curved guide 170 to overlap end 64 of seal strip 62 as shown in FIG. 14. With this structure, the seal can be maintained all the way to the bottom in the side frames and clear down to the carpet to effectively prevent infiltration and loss of thermal insulation effeciency.

Figure 15:
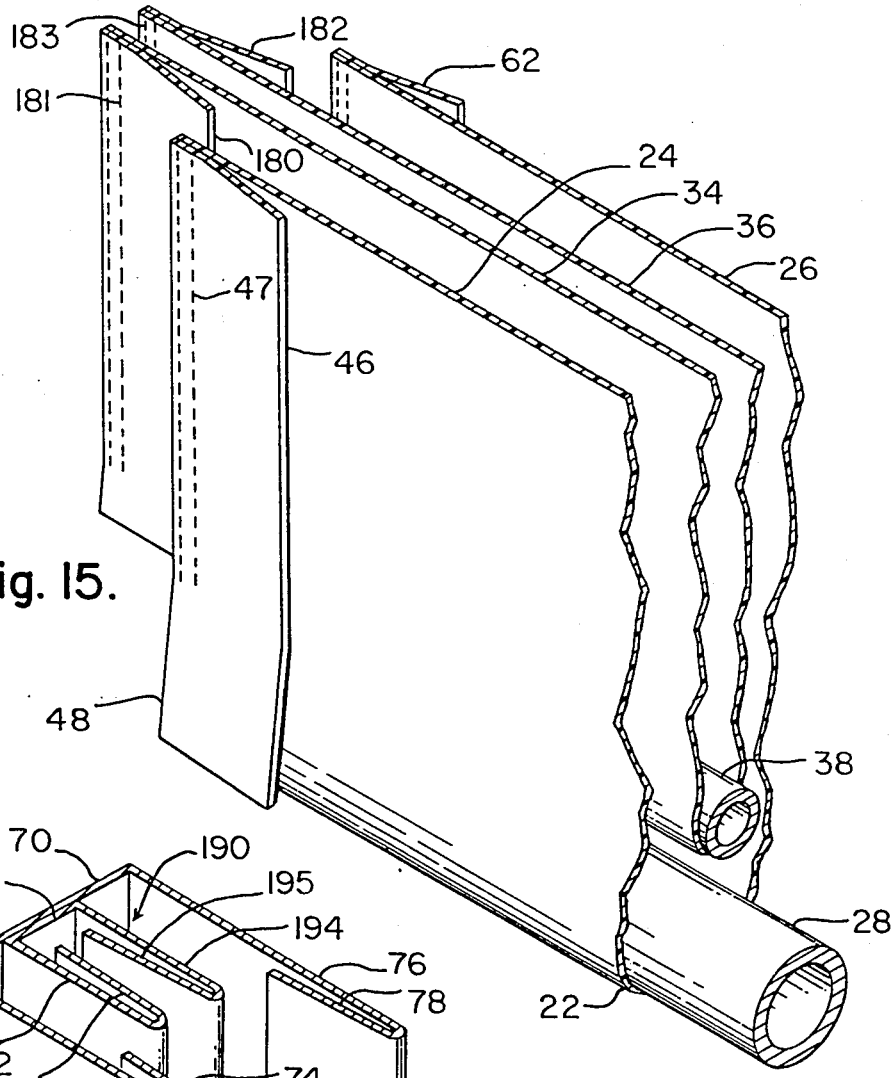
FIG. 15 is a perspective view of the front lower left portion of another alternative embodiment of the insulation material showing the details of seals for both the inner and outer layers of the insulation material.
Figure 16:
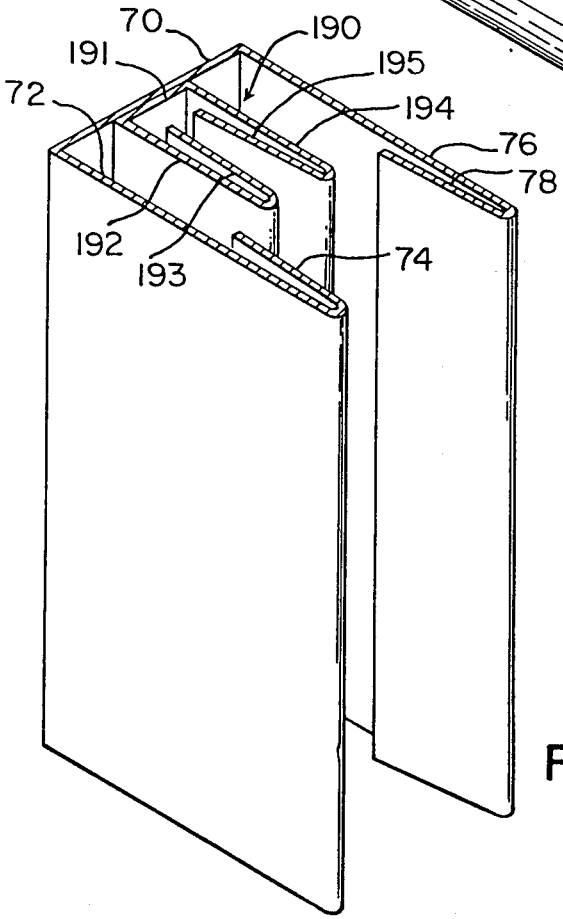
FIG. 16 is a perspective view of a portion of the left channel frame assembly of an alternative embodiment designed to guide and hold the seals of the insulation materials shown in FIG. 15.

Another alternative embodiment of the seals in the side frame channels is shown in FIGS. 15 and 16. These side seals are basically the same as those described above for the outer layers 24, 26 with the seal strips 46, 62 engaged with seal guides 74, 76, respectively. However, in this embodiment, seal strips 180, 182 are added to the lateral edges of inner layers 34, 36, as shown in FIG. 15. The inner layers 34, 36 are made slightly wider than the outer layers 24, 26 so that the lateral edges of inner layers 34, 36 extend outwardly beyond the edges of outer layers 24, 26. Seal strip 180 is attached to the edge of inner layer 36 by stitching 183 in a manner similar to the attachment of seal strips 46, 62 to outer layers 24, 26, as described above.

The side frame channel, as shown in FIG. 16, has front seal guide 74 and rear seal guide 78 to engage seal strips 46, 62 as already described above. However, in addition, a smaller channel 191 is provided inside the outer channel frame and includes a front panel 192 and a rear panel 195 in parallel spaced apart relation to each other extending inwardly from the side panel 70 of the outer frame channel. The distal end of front panel 192 is bent inwardly to return toward itself to form seal guide 183, and rear panel 194 is bent inwardly to return toward itself to form seal guide 195. By considering FIG. 15 in combination with FIG. 16, it can be appreciated that the seal strips 180, 182 on inner layers 34, 36 are adapted to engine seal guides 193, 195 on the inner channel frame shown in FIG. 16, while the seal strips 46, 62 are adapted to engage seal guides 74, 78 to seal the outer layers 24, 26.

This latter embodiment has two major advantages. The first advantage is to seal the intermediate insulation pocket 42 from the front and rear insulation pockets 40, 44, respectively, to further minimize convection currents inside the insulation pockets. The second advantage is that this structure alleviates a problem encountered in installations where the layers extend wholly or partially in horizontal or inclined panels, as opposed to vertical panels. In such non-vertical installations, the layers tend to lay against each other causing cold shorts where heat can be conducted through the layers and not interrupted by insulation air pockets. The lateral seals on the inner layers of this embodiment, in addition to those provided on the outer layers, tend to keep the layers separated from each other in non-vertical applications, thereby maintaining the insulation air pockets between the layers to enhance the thermal insulation effeciency of the assembly.

Although the present invention has been described with a certain degree of particularily, it is understood that the present disclosure has been made by way of example and the changes in details of structure may be made without departing from the spirit thereof.

I claim:

1. In movable insulation having three layers of material forming air pockets therebetween and motion producing means connected to said layers for moving the insulation over an area to be covered and retracting the insulation away from said area, the improvement comprising:

side seal means located at the lateral edges of said layers for both preventing air infiltration currents from flowing from the interior of said air pockets to the exterior around said lateral edges and for mechanically resisting transverse forces in said layers caused by bulging of said layers as they are moved over and retracted from said area, said side seal means including first and second pairs of flexible outer seal strips attached to and located at the outside layers of said insulation, one member of each pair being secured to the outer surface of one outside layer and the other member of each pair being secured to the outer surface of the other outside layer, each said seal strip having a free edge, and including first and second flexible inner seal strips attached to opposite lateral edges of an inner layer of said insulation;

said side seal means also including a pair of elongated channel-shaped members each defined by a bottom and a pair of upstanding fins adapted to be positioned over a respective one of the said lateral edges of said outer layers, each said channel member having an outer guide member attached to each of its fins and projecting toward its said bottom, and including an inner guide member positioned in each said channel-shaped member in a manner capable of resisting a transverse force thereon;

said outer guide members of each channel-shaped member positively engaging a respective one of said outer seal strips with each said outer seal strip positioned between its respective outer guide member and a respective fin thereof, and each said inner guide member being positioned between its respective inner seal strip and the adjacent layer of its associated inner layer, whereby said inner guide members and said outer guide members mechanically separate said inner layer and said outer layer into spaced-apert relation to one another as the insulation is moved over the area to be covered.

2. The improvement of claim 1, wherein said outer guide members are each extensions of opposite ones of said fins of said channel-shaped member folded inwardly to return toward themselves with a narrow gap left between each outer guide member and the respective adjacent fin to slidably receive one of said outer seal strips therein with the adjacent outer layer slidably positioned on the opposite side of said outer guide member.

3. The improvement of claim 1, wherein said inner flexible seal strip is unattached to said adjacent layer near the bottom of said layer.

4. The improvement of claim 3, including curved guide means at the bottom of said channel-shaped member for directing said unattached portion of said guide strip away from the bottom of said channel-shaped member.

5. The improvement of claim 4, wherein said curved guide means includes a curved guide surface extending downwardly and inwardly from one of said gaps and then upwardly toward the other of said gaps.

6. The improvement of claim 1, wherein said air pockets are collapsed with said multiple layers in contact with each other in the vicinity of said motion producing means and expanded with said multiple layers separated a spaced distance from each other over the area to be covered by the movable insulation, and wherein said outer guide members extend divergingly from the position where said layers are in contact with each other to the position where the layers are separated from each other in such a manner that said outer guide member for each outer layer mechanically guides said respective outer layers to spaced-apart positions from each other and from said inner layers.

7. The improvement of claim 1, wherein said outer guide members extend longitudinally beyond said respective fins and converge toward each other in said extensions beyond said fins.

8. The improvement of claim 1, including a decorative fabric layer positioned over the exterior surface of one of said outer layers in a manner to conceal said exterior surface, the lateral edge of said decorative fabric being positioned in said channel-shaped member between said outer guide member and said one outer layer that is engaged with said guide member in such a manner that said decorative fabric is slidable longitudinally in said channel-shaped member with said layers of material.

9. The improvement of claim 8, wherein said decorative fabric is attached to said motion producing means.

10. The improvement of claim 8, wherein said decorative fabric is removably attached to said one outer layer.

11. The improvement of claim 8, wherein said decorative fabric is removably and adjustably attached to said one outer layer by a "Velcro" hook and loop type fastener strip near the connection of said one outer layer to said motion producing means.

12. In movable insulation having two layers of material forming an air pocket therebetween and motion producing means connected to said layers for moving the insulation over an area to be covered and retracting the insulation away from said area, the improvement comprising:

side seal means located at the lateral edges of said layers for both preventing air filtration currents from flowing from the interior of said air pockets to the exterior around said lateral edges and for mechanically resisting transverse forces in said layers caused by bulging of said layers while accommodating longitudinal movement of said layers as they are moved over and retracted from said area, said side seal means including an elongated thin, flexible seal strip attached to a lateral edge of each of said layers of material in such a manner that the strip is positioned to lay flat against the layer of material with the respective outboard edges of the layer of material and the strip fastened together and the inboard edge positioned adjacent, but not attached, to the layer of material, and an elongated channel-shaped member having a pair of elongated guide members positioned adjacent and adapted to engage the outside surface of said seal strips, and each of said guide members having an elongated parallel fin adjacent thereto with a space between the guide member and the fin adapted to slidably receive the unattached inboard edge of one of said strips such that the fin will engage the inside surface of the strip near its attached outboard edge, and wherein the lower portion of said strips are not attached to said layers of material for a spaced distance upwardly from the bottom of said layers of material and the guide member extends a spaced distance below said fin.

13. The improvement of claim 12, wherein said guide members are curved at the bottom.

14. The improvement of claim 13, wherein said two guide members of said channel are curved to join each other in a continuous curved surface.

15. Sealed movable insulation assembly, comprising:

insulation curtain material adapted for movement into place over an area of a building wall desired to be insulated, said curtain material being comprised of two sheet layers adapted for positioning over said wall area to be covered in approximately parallel relation thereto with said layers being adjacent and approximately parallel to each other, said sheet layers being movable apart from one another to form an insulating air pocket therebetween and connected together at the bottom to seal said air pocket at the bottom from the exterior;

side seal and anchor means on each lateral side of said curtain for both sealing said air pocket at the sides from the exterior and mechanically anchoring said lateral sides of said curtain in sealing relation with said side seal and anchor means, said side seal and anchor means including a pair of first channel members having upstanding webs and each adapted to receive one of the lateral edges of said curtain, each said web supporting a strip-shaped guide member thereon with each guide member having a free edge projecting toward the bottom of its respective channel member internally thereof and including a seal strip adjacent each lateral edge of the exposed surfaces of each outermost ones of said layers, each said seal strip having a longitudinal edge secured to its associated layer and a free edge opposite said longitudinal edge, each said guide member adapted to receive a respective one of said seal strips whereby its respective seal strip is mateably positioned between the guide member and its associated web and the guide member is mateably positioned between its respective seal strip and the outer layer to which its respective seal strip is secured;

motion producing means attached to said curtain for moving said curtain away from said wall area and for moving said curtain over said wall area including a roller at the top of the curtain around which the curtain can be rolled to retract it from the wall area to be covered, said side seal and anchor means operative to mechanically separate said layers into a spaced-apart relation to one another as an aid in forming said air pockets; and a housing that completely encloses said motion producing means except for an elongated opening in the underside thereof for accommodating passage of said curtain therethrough, the front and rear edges of said opening being in physical contact with the exterior surfaces of the outer layers of said curtain and the sides of said opening being continuously joined with said side seal and anchor means in an air-tight manner in such a manner that the air pocket between the layers and the interior of the housing form one continuous air-tight chamber around and below the motion producing means sealed from the exterior.

16. The assembly of claim 15, wherein the front layer of the curtain is attached to said roller a spaced angular distance from the attachment of the remainder of the layers to said roller such that said roller will pull said front layer forwardly into contact with the front edge of said opening.

17. The assembly of claim 15, wherein said top seal means includes constriction members at the top of said curtain to constrict said layers together at the top to seal said air pockets from the exterior, said construction members being adapted to allow sliding movement of said layers therethrough.

18. The assembly of claim 15, including a plurality of separator rollers positioned in said opening between said layers and journaled for rotation in said housing for mechanically separating said layers and forcing the layers into contact with the edges of said opening in the housing to create a seal as they proceed through said opening.

19. The assembly of claim 15, including a decorative fabric positioned in front of said front layer with the lateral edges of said decorative fabric slidably positioned between said front layer and said front seal guide and anchor member.

20. The assembly of claim 19, wherein said decorative fabric is removably attached to said front layer across the top edge of said decorative fabric near the attachment of said front layer to said roller.

21. The assembly of claim 20, wherein said attachment of said decorative fabric to said front layer is adjustable to selectively vary the position of the bottom edge of said decorative fabric in relation to the bottom of said curtain.

22. The assembly of claim 15, wherein the bottom portion of said seal strips are not attached to the lateral edges of said respective layers.

23. The assembly of claim 22, including a curved guide surface at the bottom of said channel-shaped member to guide the bottom portion of said seal strip inwardly and upwardly to prevent jamming at the bottom of said channel-shaped member.

24. The assembly of claim 15, including extensions of said seal guide and anchor members above said front and rear panels and coverging toward said opening in said housing to engage the lateral edges of said layers and separate them as they emerge from said opening.

25. The assembly of claim 15, including an inner elongated channel-shaped member positioned inside said outer elongated channel-shaped member with the open side of said inner channel positioned to receive therein the lateral edges of the inner layers of said curtain, the front and rear panels of said inner channel-shaped member being folded at their distal ends to return inwardly toward themselves to form inner front and rear rigid seal guide and anchor members, and including elongated seal strips connected to the lateral edges of the inner layers and returning along the exterior surfaces of said inner layers in an adjacent plane thereto a distance comparable to the width of said inner seal guide and anchor members, said lateral edges of said outer layers being slidably positioned in said inner channel-shaped member with the front inner seal guide and anchor member positioned between the seal strip and the exterior surface of the front inner layer and with the rear inner seal guide and anchor member positioned between the seal strip and the exterior surface of the rear inner layer.

* * * * *

UNITED STATES PATENT AND TRADEMARK OFFICE

CERTIFICATE OF CORRECTION

PATENT NO. : 4,453,584

DATED : June 12, 1984

INVENTOR(S) : Richard S. Steele

It is certified that error appears in the above-identified patent and that said Letters Patent is hereby corrected as shown below:

Column 2, line 48, delete "maintainence" and substitute --maintenance--.

Column 4, line 56, after "24" insert --.--.
Column 4, line 59, delete "32" (first occurrence) and substitute --34--.
Column 6, line 7, delete "frme" and substitute --frame--.
Column 6, line 44, delete "The" (second occurrence) and substitute --This--
Column 7, line 25, after "left" insert --side--.
Column 7, line 53, delete "bind-frree" and substitute --bind-free--.
Column 8, line 43, delete "inerior" and substitute --interior--.
Column 9, line 11, delete "edcorative" and substitute --decorative--.
Column 11, line 58, delete "183" and substitute --193--.
Column 11, line 62, delete "engine" and substitute --engage--.
Column 12, line 17, delete "particularily" and substitute --particularity--.

UNITED STATES PATENT AND TRADEMARK OFFICE

CERTIFICATE OF CORRECTION

PATENT NO. : 4,453,584

DATED : June 12, 1984

INVENTOR(S) : Richard S. Steele

It is certified that error appears in the above-identified patent and that said Letters Patent is hereby corrected as shown below:

Claim 1, column 12, line 64, delete "layer" (second occurrence) and substitute --layers--.

Claim 1, column 12, line 65, delete "spaced-apert" and substitute --spaced-apart--.

Claim 17, column 15, line 29, delete "construction" and substitute --constriction--.

Signed and Sealed this

*Nineteenth* Day of *March 1985*

[SEAL]

*Attest:*

DONALD J. QUIGG

*Attesting Officer*

*Acting Commissioner of Patents and Trademarks*